United States Patent [19]

McFarland

[11] Patent Number: 4,759,341

[45] Date of Patent: Jul. 26, 1988

[54] SLIDING RAIL SUPPORT SYSTEM

[75] Inventor: Robert H. McFarland, Mansfield, Ohio

[73] Assignee: The Tappan Company, Ohio

[21] Appl. No.: 917,663

[22] Filed: Oct. 10, 1986

[51] Int. Cl.[4] ..... F24C 15/16

[52] U.S. Cl. ..... 126/339; 126/340; 384/23; 312/341 NR

[58] Field of Search ..... 126/339, 337 R, 340; 384/23, 42, 901; 312/330 R, 332, 341 NR, 346, 338; 248/420, 429; 211/94, 162

[56] References Cited

U.S. PATENT DOCUMENTS 2,295,697 9/1942 Sulentic ..... 312/338
4,440,461 4/1984 Powell et al. ..... 384/23

FOREIGN PATENT DOCUMENTS 1282698 12/1961 France ..... 312/341 N R
288066 12/1952 Switzerland ..... 312/338

*Primary Examiner*—Samuel Scott
*Assistant Examiner*—Noah Kamen
*Attorney, Agent, or Firm*—Alfred E. Miller

[57] ABSTRACT

A slidable support system is formed of two rails having opposed channels. The rails have flat mounting surfaces adapted to be affixed to a support and an element to be slidably mounted, and at least two bearings are provided extending into the channels of both of the rails. The bearings have generally cruciform cross sections, and may be affixed to one of the respective rails, or free-floating with respect to both of the rails.

13 Claims, 4 Drawing Sheets

FIG.3
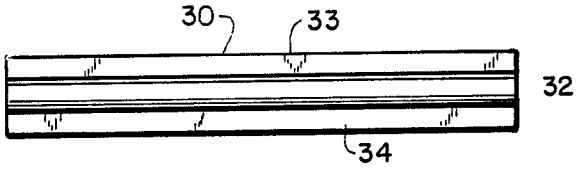
FIG.4
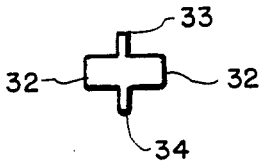
FIG.5
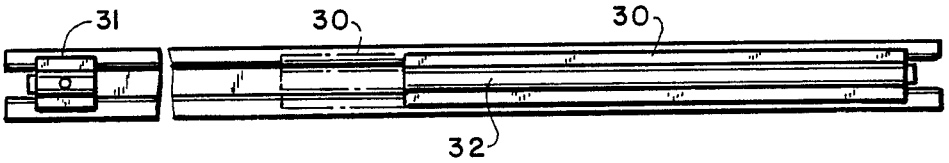
FIG.6
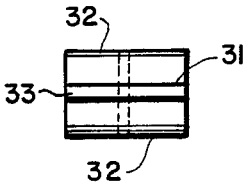
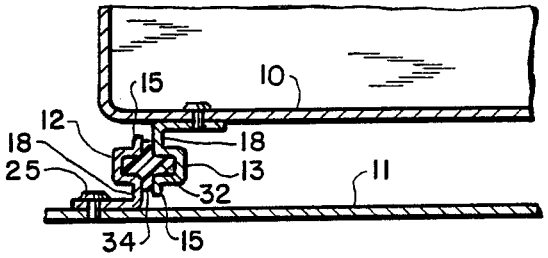
FIG.7
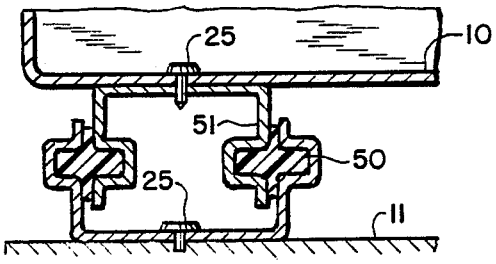
FIG.8

FIG.12
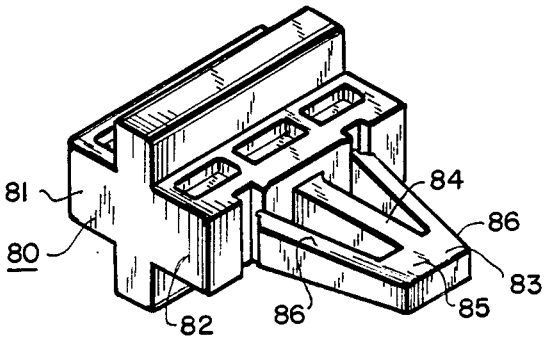
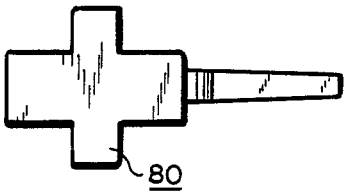
FIG.13
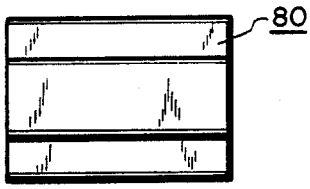
FIG.14
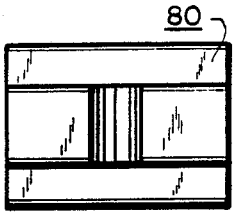
FIG.15
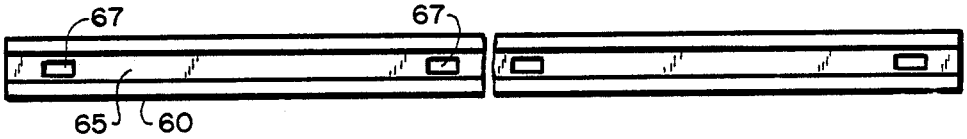
FIG.16
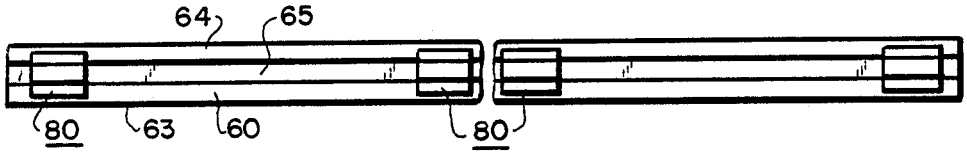
FIG.17

SLIDING RAIL SUPPORT SYSTEM

This invention relates to a sliding rail support system. While the support system of the invention is especially advantageous in the support of drawers or other objects mounted above the rails of the support system, it will be apparent that the features of the invention may be advantageously employed with other arrangements, such as for the lateral support of drawers or other objects.

While the invention will be specifically disclosed with reference to the sliding support of a drawer for an oven in view of the great advantages of the invention in such application, it will be apparent that the scope of the invention is not limited to such application.

It is conventional, in the provision of domestic ovens, to provide a drawer beneath the oven. In order to enable the ready use of the drawer, it is desirable to provide door slides or glides, so that the drawer can be easily opened and closed. While various techniques have been employed for the mounting of such drawers, prior devices have a tendency to involve a greater expense than necessary both in the provision of the required slides and other components for supporting the drawer, as well as in the installation of the slides and a drawer in the appliance. Slidable oven drawer systems are disclosed, for example, in U.S. Pat. Nos. 2,132,737; 2,133,835; 2,473,467; 2,787,381; and 3,880,716.

The present invention is therefore directed to the provision of a gliding or sliding support system for a drawer or other object, wherein the expense of the production of the components of the systems is minimized, and the support system may be installed with a minimum of effort.

Briefly stated, in accordance with the invention, the support system comprises a pair of channel shaped rails preferably having identical cross sections, with a channel formed in one respective side. In use, the rails are relatively reversed, with their channel shaped sections facing one another, and separated by plastic glides. The plastic glides have cross sections with arms extending into the respective channel shaped grooves of the adjacent rails, and ribs positioned to separate the respective rails from contacting one another. The support of an object such as a broiler carriage assembly will require the use of two pairs of such rails, with one rail of each pair being mounted to an under support and the other rail of each pair being mounted to the under side of the carriage assembly.

In order that the present invention may be more clearly understood, it will now be disclosed in greater detail with reference to the accompanying drawings, wherein:

FIG. 1 is a perspective view of a rail system in accordance with one embodiment of the invention, illustrated as supporting a drawer;

FIG. 3 is a top view of a bearing for the rail employed in the system of FIG. 1;

FIG. 4 is an end view of the bearing of FIG. 3;

FIG. 5 is a side view of a bearing and one rail, as employed in the system of FIG. 1;

FIG. 6 is a top view of another bearing for use in the system of FIG. 1;

FIG. 7 is a cross sectional view of a portion of the system of FIG. 1;

FIG. 8 is a cross sectional view of a modification of the support system of FIG. 1;

FIG. 12 is a perspective view of a bearing employed in the system of FIGS. 9–11;

FIG. 13 is an end view of the bearing of FIG. 12;

FIG. 14 is one side view of the bearing of FIG. 12;

FIG. 15 is the other side view of the bearing of FIG. 12;

FIG. 16 is a broken away side view of a rail which may be employed in the system of FIGS. 9–11; and FIG. 17 is a broken away view of the rail of FIG. 16, with bearings of the type illustrated in FIG. 12 snapped therein.

DETAILED DISCLOSURE OF THE INVENTION

Figure 2:
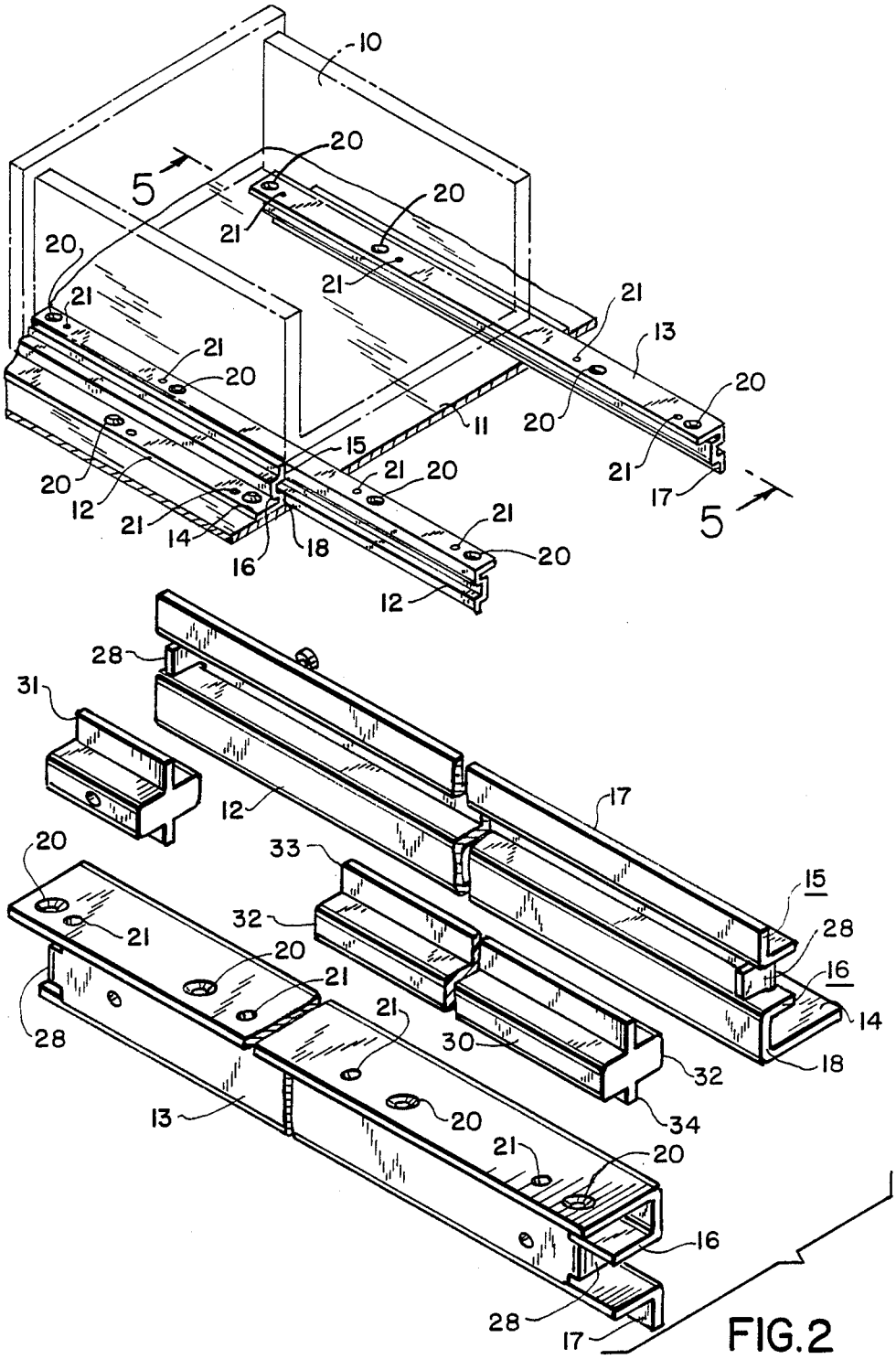
FIG. 2 is an enlarged expanded view of a portion of the rail system employed in the system of FIG. 1.

FIGS. 1, 2 and 7 show a support system in accordance with the invention for slidably mounting a drawer, such as a sheet metal drawer 10 on a frame, such as a horizontal sheet metal support 11. The support system is comprised of a pair of rails 12, 13, having identical cross sections. The rails 12, 13 may be formed of sheet metal, with their cross sections relatively reversed with respect to one another. The use of identical cross section rails minimizes the production cost of the support system of the invention, by minimizing the required manufacturing procedures.

As illustrated in FIG. 2, considering for the moment rail 12, the rail has a flat mounting side 14, and an upright side 15 extending at right angles from one edge of the side 14. The upright side 15 has a longitudinally extending channel shaped midsection 16 with upper and lower flanges 17 and 18, respectively. The midsection 16 extends over the mounting side 14, and the flanges 17 and 18 lie in a common plane at right angles to the plane of the side 14, with the flange 15 defining an upper free flange and the flange 18 defining a lower flange joining the side 14.

The side 14 is adapted to be mounted flush to the support surface for the system, and may be provided with suitable holes for mounting screws or the like. For example, as illustrated in FIGS. 1 and 2, holes 20 may be formed in dimples on the side 14 defining nuts for screws (not shown) extending upwardly through the support into the side 14. Alternatively, or in addition, holes 21 may be provided for receiving sheet metal mounting screws 25, for mounting the rail on the support 11, as illustrated in FIG. 7.

Referring again to FIG. 2 the ends of the channel shaped section 16 are bent over to provide flanges 28 blocking the ends of the channel sections.

As illustrated more clearly in FIG. 7, the rails 12, 13 are mounted, with respect to one another, with the open sides of their channel shaped grooves facing one another.

The support in accordance with this embodiment of the invention is provided with two bearings of plastic material. The selection of materials for the bearings is dependent upon the operating temperature to which the support system will be subjected. As an example, Teflon has been found to be satisfactory as a bearing material for use in a support system in accordance with the invention for the broiler drawer of a domestic gas oven. The two bearings have identical cross sections, as illustrated in the end view of FIG. 4, one of the bearings 30 as illustrated in FIG. 3 bearing considerably longer that the other 31 as illustrated in FIG. 6.

As illustrated in FIG. 4, the cross section of the bearings is generally cruciform, the bearings having lateral projections 32 of substantially the cross section of the channel grooves of the rails, and upper and lower ribs 33, 34 adapted to separate the respective rails. Thus, as illustrated in FIG. 7, the lateral projections 32 substantially fill the channel grooves while the rib 33 engages and slidingly separates the free flange 15 of the lower guide rail 12 and the non-free flange 18 of the guide rail 13. Similarily, the rib 34 slidingly engages and separates the lower flange 18 of the rail 12 and the free flange 15 of the rail 13. The two bearings 30, 31 are mounted in the channel shaped grooves, and held therein by the end flanges 28.

As illustrated in FIGS. 1 and 2, the bearing 31 may be fixedly mounted in the channel groove of one of the rails (although this is not absolutely necessary). For example, the bearing 31 may be affixed in the channel groove 16 of the upper rail 13 at the end thereof adjacent the rear of the drawer 10, or it may be affixed in the channel groove 16 of the lower rail 12 at the end thereof under the front of the drawer 10 when the drawer 10 is closed. The holding of the bearing 31 in the channel shaped groove may be effected by any conventional means, such as a screw extending through the bottom of the rail and into the bearing. The other bearing 30 is confined in the respective channel groove only by the channel grooves themselves and the flanges 28. In the open position of the drawer, the two bearings may, of course, contact one another. The two bearings have a combined length that is sufficiently short to enable opening of the drawer to the desired extent. The bearing 31 that is fixedly mounted is preferably significantly shorter that the free floating bearing 30 in order to facilitate assembly and disassembly of the support assembly as will be discussed. In one embodiment, for example, the rails 12, 13 each had a length of 17 inches, with the end flanges 28 being about a quarter of an inch from the ends of their respective rails. In this instance, the bearing 31 had a length of about 0.75 inches, while the bearing 30 had a length of about 5 inches. This arrangement permitted a drawer opening of about 10¾ inches. Decreases in the length of the free floating bearing in this instance, while permitting larger drawer openings, result in progressively less stable support of the drawer in the event that the free floating bearing becomes jammed against the fixed bearing in the closed condition of the drawer. By fabricating the bearings to have an overall length as above discussed, however, in accordance with the invention, it is not necessary to affix either of the bearings in the respective rails.

Assembly and disassembly of the support system in accordance with the invention is simplified due to the fact that the majority of the screws holding the rails to the drawer and system support may be mounted prior to assembly of the system. For example, an upper rail 13 may be affixed firmly to each of the underside edges of the drawer, and one end screw mounted to a common end of each of the corresponding lower rails 12. The lower rails may then be pivoted away from one another about the screws that have been mounted, to enable the bearings to be inserted in the channel grooves. The lower rails may then be pivoted to their final positions and the remaining screws placed therein. The difficulty in prior mounting arrangements of locating the screw holes for the guide rails is thereby avoided.

In the embodiment of the invention illustrated in FIG. 8, the rails 50, 51 are U-shaped, with channel shaped grooves in the opposite sides of the U-shape. In this instance, the rails are of different shape and size, since one of the rails must fit within the other, and the channel grooves must face opposite directions. This arrangement provides the advantage of increased weight bearing capacity, as compared with the arrangement illustrated in FIG. 1.

Figure 9:
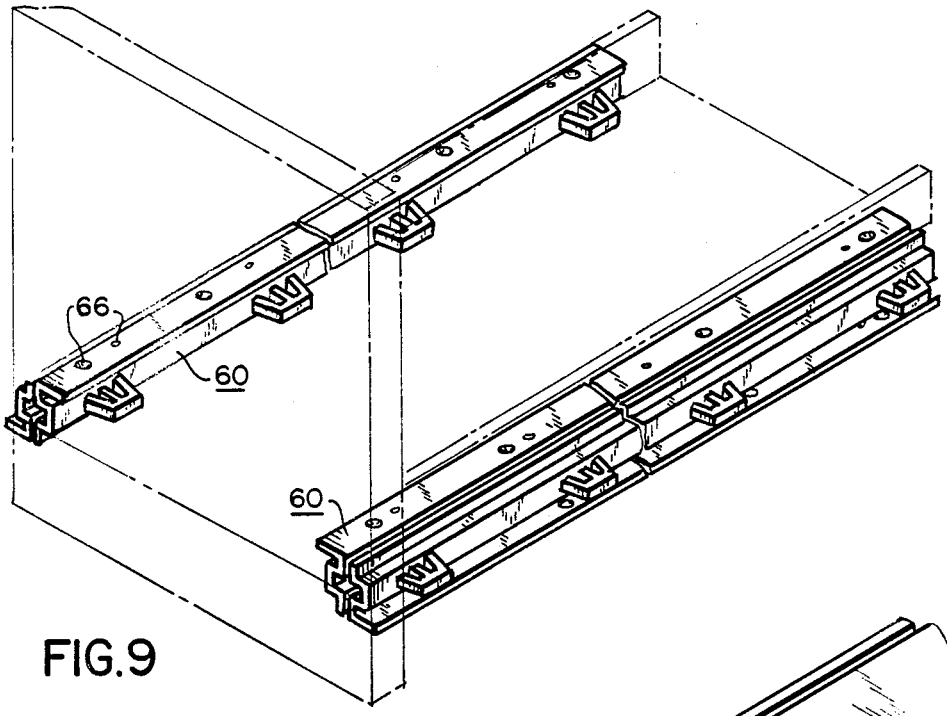
FIG. 9 is a perspective view of a rail system in accordance with a further embodiment of the invention.
Figure 10:
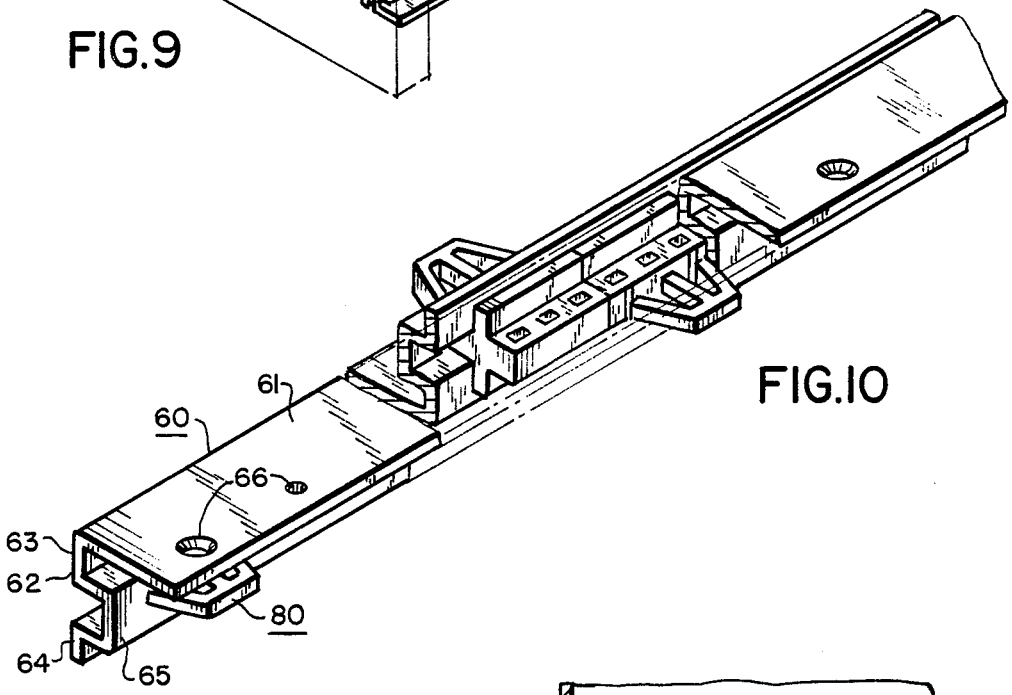
FIG. 10 is an enlarged perspective cutaway view of a rail employed in the system of FIG. 9.
Figure 11:
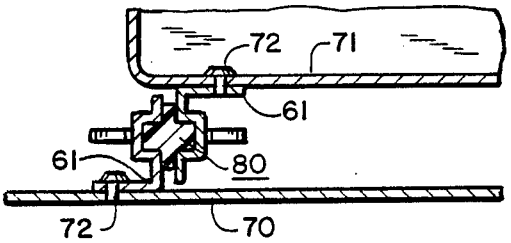
FIG. 11 is a cross sectional view of a rail of the type illustrated in FIGS. 9 and 10, including a support and drawer supported thereby.

In the embodiment of the invention illustrated in FIGS. 9–17, the bearings are in the form of snap inserts, preferably of a plastic material, thereby simplifying assembly of the slide support system and adapting it to various arrangements. As illustrated in FIGS. 9–11, 16 and 17, the rail system is comprised of pairs of identical rails 60 having flat mounting sides 61 and channel sides 62, the channel sides 62 having portions 63 and 64 lying in a plane normal to the plane of the side 61, and separated by a channel 65 overlying (or underlying) the mounting side 61. The side portion or flange 63 depends from the mounting side 61. As illustrated in FIGS. 9–11, suitable, conventional mounting holes 66 may be provided for mounting the sides 61, for example, to a support surface 70 or drawer bottom 71, for example, by means of sheet metal screws 72 or the like. The bottoms of the channel portions 65 are provided with rectangular apertures or slots 67 for receiving the plastic bearings 80.

The bearings 80 have a generally cruciform cross section, as in the previously disclosed embodiments of the invention, with opposed arms 81, 82, extending into and closely fitting the channels of the rails, as illustrated in FIGS. 10 and 11. A snap projection 83 depends from the arm 82, and is shaped to be snapped into a hole 67 of one of the rails 60. The snap projection 83 may be of any conventional design to rigidly hold the bearing to the rail. In the illustrated embodiment, for example, the snap projection 83 has a central arm 84 extending centrally of the bearing in the plane of the arms 81, 82, and having a T-shaped end 85 that supports resilient arms 86 extending at an angle toward the arm 82. The projection 83 is shaped to extend into the hole 67 of a rail while depressing the resilient arms 86, so that the arms 86 spring back upon the full extension of the projection 83 into the hole 67, to engage, at least in part, the opposite side of the rail, to inhibit release of the bearing from the rail.

The bearings 60 are preferably fitted at desired locations of each of the rails 60 of a pair of rails, to permit the desired opening range of the drawer, as well as to stop the drawer in the open, as well as in the closed positions. In order to adapt the system to different degrees of opening of a drawer, the rails are preferably provided with a plurality of mounting aperture 67 that may be employed as necessary.

The rail system of FIGS. 9–17 may be assembled for the support of a drawer in the same manner as the earlier described embodiments of the invention, although in this case the time of fitting the bearings to the rails is less critical.

The bearings 60 are preferably moulded in a single piece, employing the same criteria for the plastic material as discussed with reference to the system of FIG. 1.

While the invention has been disclosed and described with reference to several embodiments, it is apparent that variations and modifications may be made therein, and it is therefore intended in the following claims to cover each such variation and modification as follows within the true spirit and scope of the invention.

What is claimed is:

1. A slidable support system comprising first and second rails, ech said rail having a generally angle shaped cross section with first and second sides joined along an edge and extending substantially perpendicular to one another, the first sides of each rail being substantially flat and defining a mounting surface, the second sides of each rail having a channel shaped groove extending longitudinally therein, said rails being positioned with the open sides of their respective channel grooves facing one another and their mounting surfaces in first and second parallel spaced apart planes on opposite sides of said facing channel grooves, said first sides having mounting means to enable said rails to be mounted with said first sides thereof in separate ones of said parallel spaced apart planes, and first and second bearings in said grooves, said bearings having cruciform cross sections with lateral projections extending in opposite channel grooves of the rails and ribs extending between and spacing said rails, and further comprising first and second relatively movable members having mounting surfaces in said first and second planes respectively, the mounting surfaces of said first sides of said first and second rails being affixed to said first and second members, respectively, by said mounting means, said mounting means comprising means enabling relative pivoting between said first and second rails.

2. The support system of claim 1 wherein said rails have identical cross sections.

3. The support system of claim 1 wherein at least one of said bearings is free-floating in the respective channel grooves.

4. The support system of claim 1 wherein at least one of said bearings is affixed in the channel grooves of said first rail and adapted to be freely slidable in the channel groove of said second rail.

5. The support system of claim 4 wherein said one bearing is snap-fit in the channel groove of said first rail.

6. The support system of claim 1 wherein said first sides extend from said second side in the same direction as the respective channel.

7. The support system of claim 1 wherein said mounting means comprises mounting holes in said first sides.

8. A slidable support system comprising first and second rails, each said rail having a generally angle shaped cross section with first and second sides joined along on edge and extending substantially perpendicular to one another, the first sides of each rail being substantially flat and defining a mounting surface, the second sides of each rail having a channel shaped groove extending longitudinally therein, said rails being positioned with the open sides of their respective channel grooves facing one another and their mounting surfaces in first and second parallel spaced apart planes, said first sides having mounting means to enable said rails to be mounted with said first sides thereof in separate ones of said parallel spaced apart planes, and first and second bearings in said grooves, said bearings having cruciform cross sections with lateral projections extending in opposite channel grooves of the rails and ribs extending between and spacing said rails, at least one of said bearings being affixed in the channel grooves of said first rail and adapted to be freely slidable in the channel groove of said second rail, said one bearing being snap-fit in the channel groove of said first rail, said one bearing having a snap projection extending from one lateral projection thereof, said snap projection being snapped into an aperture in the bottom wall of the respective channel shaped groove.

9. A slidable support system comprising first and second rails, each said rail having a generally angle shaped cross section with first and second sides joined along an edge and extending substantially perpendicular to one another, the first sides of each rail being substantially flat and defining a mounting surface, the second sides of each rail having a channel shaped groove extending longitudinally therein, said rails being positioned with the open sides of their respective channel grooves facing one another and their mounting surfaces in first and second parallel spaced apart planes, said first sides having mounting means to enable said rails to be mounted with said first sides thereof in separate ones of said parallel spaced apart planes, and first and second bearings in said grooves, said bearings having cruciform cross sections with lateral projections extending in opposite channel grooves of the rails and ribs extending between and spacing said rails, the ends of said channel shaped grooves having bent over portions inhibiting the passage of said bearings therethrough.

10. A slidable support system comprising first and second rails, each said rail having a generally angle shaped cross section with first and second sides joined along an edge and extending substantially perpendicular to one another, the first sides of each rail being substantially flat and defining a mounting surface, the second sides of each rail having a channel shaped groove extending longitudinally therein, said rails being positioned with the open sides of their respective channel grooves facing one another and their mounting surfaces in first and second parallel spaced apart planes, said first sides having mounting means to enable said rails to be mounted with said first sides thereof in separate ones of said parallel spaced apart planes, and first and second bearings in said grooves, said bearings having cruciform cross sections with lateral projections extending in opposite channel grooves of the rails and ribs extending between and spacing said rails, said first bearing being fixedly held to said first rail and said second bearing being fixedly held to said second rail.

11. The support system of claim 10 wherein said first and second bearings are snap fit to said first and second rails, respectively.

12. A slidable support system comprising first and second rails, each said rail having a generally angle shaped cross section with first and second sides joined along an edge and extending substantially perpendicular to one another, the first sides of each rail being substantially flat and defining a mounting surface, the second sides of each rail having a channel shaped groove extending longitudinally therein, said rails being positioned with the open sides of their respective channel grooves facing one another and their mounting surfaces in first and second parallel spaced apart planes on opposite sides of said facing channel grooves, said first sides having mounting means to enable said rails to be mounted with said first sides thereof in separate ones of said parallel spaced apart planes, and first and second bearings in said grooves, said bearings having first projections extending in opposite channel grooves of the rails and ribs extending between and spacing said rails, one first projection of said first and second bearings being affixed in the channel of said first and second rail, respectively, and the other first projection of said first and second bearings being freely movable in the channel of the second and first rails, respectively.

13. A slidable support system comprising first and second rails, each said rail having a generally channel shaped cross section with first and second parallel spaced apart arms joined along parallel edges to a central section, the central sections being substantially perpendicular to the respective arms, the central section of each rail being substantially flat and defining a mounting surface, the first and second arms of each rail each having a channel shaped groove extending longitudinally therein, with the opens sides of the channels of the first rail facing one another and the open sides of the rails of the second rail facing away from one another, the width of said second rail being less than that of said first rail, the second rail being positioned within said first rail with the open sides of the channel grooves of adjacent rail arms facing one another and the mounting surfaces of the first and second rails being in first and second parallel spaced apart planes on opposite sides of said facing channel grooves, and first and second bearings in each pair of said facing grooves, said bearings having cruciform cross sections with lateral projections extending in opposite channel grooves of the rails and ribs extending between said rails, one lateral projection of each bearing being affixed in the groove of one of the respective pairs of facing grooves with said affixed projections of each pair of bearings being affixed to opposite rails.

* * * * *